United States Patent [19]

Ohringer

[11] 4,129,906

[45] Dec. 19, 1978

[54] NORMALLY CLOSED SEWAGE VENTING SYSTEM

[76] Inventor: Jack G. Ohringer, 1435 Dolores St., San Francisco, Calif. 94110

[21] Appl. No.: 419,559

[22] Filed: Nov. 28, 1973

[51] Int. Cl.[2] ..... E03D 9/04

[52] U.S. Cl. ..... 4/211; 4/219

[58] Field of Search ..... 4/2, 72, 74, 209, 210, 4/211, 213, 216, 218, 219, 10, 191, 300; 137/493, 525.1, 845, 849; 210/218

[56] References Cited

U.S. PATENT DOCUMENTS

| | | | |
|---|---|---|---|
| 992,882 | 5/1911 | Kletzsch | 4/211 |
| 1,772,214 | 8/1930 | Gandillon | 4/211 UX |
| 1,963,354 | 6/1934 | Currie | 210/218 X |
| 2,127,184 | 8/1938 | O'Leary | 4/211 |
| 3,108,610 | 10/1963 | De See | 137/493 |
| 3,151,626 | 10/1964 | Everett | 137/493 |
| 3,187,897 | 6/1965 | Walker | 210/218 X |
| 3,605,132 | 9/1971 | Lineback | 4/211 |
| 3,811,466 | 5/1974 | Ohringer | 137/493 |

*Primary Examiner*—Stuart S. Levy
*Attorney, Agent, or Firm*—R. S. Sciascia; Charles D. B. Curry

[57] ABSTRACT

A normally closed sewage venting system comprising at least one or more plumbing fixtures having associated traps and drain lines that empty into a main drain that is connected to a sewer main. The main drain is normally directly vented to atmosphere by a plumbing vent. In accordance with the present invention each plumbing vent is capped off with a breather valve. The breather valve is a slit diaphragm valve that readily permits air to enter the system, to prevent syphoning from the traps, and prevents the escape of gases from the system except under predetermined excessive pressure conditions. Therefore, the gases previously emitted to the atmosphere are now drawn, with the drainage, into the sewer main. The sewer main may be subjected to a slight negative pressure which draws the sewer gases off and into a gas separation and storage facility where the noxious gases can be neutralized and the burnable gases processed and stored.

4 Claims, 6 Drawing Figures

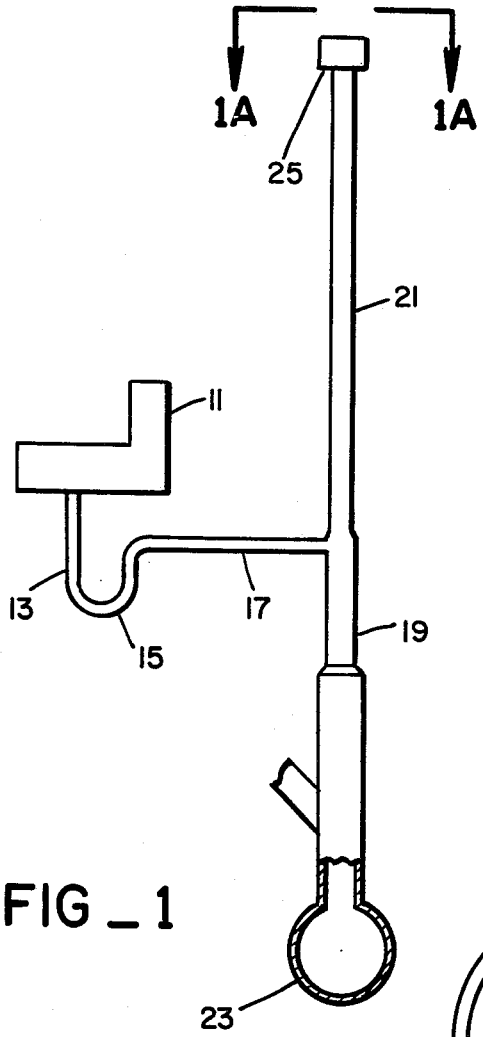
FIG _ 1
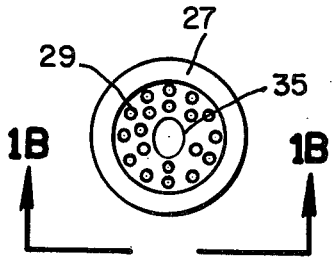
FIG _ 1A
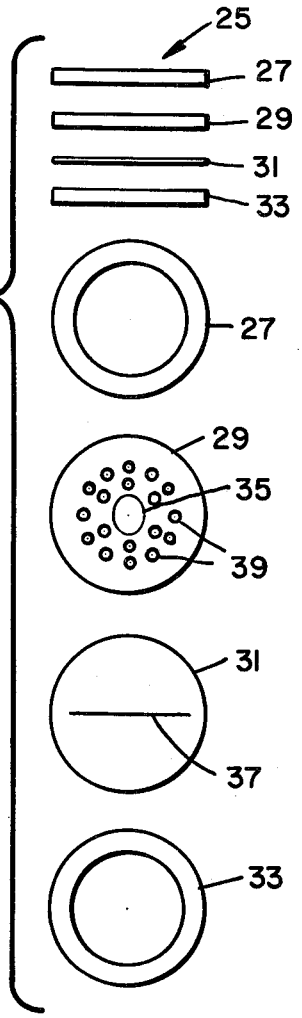
FIG _ 1B
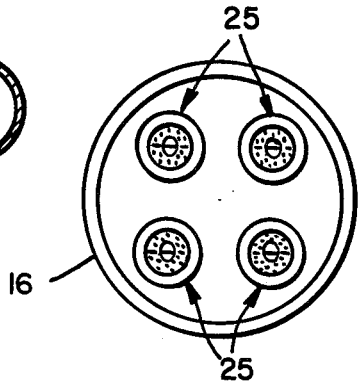
FIG _ 2
FIG _ 4
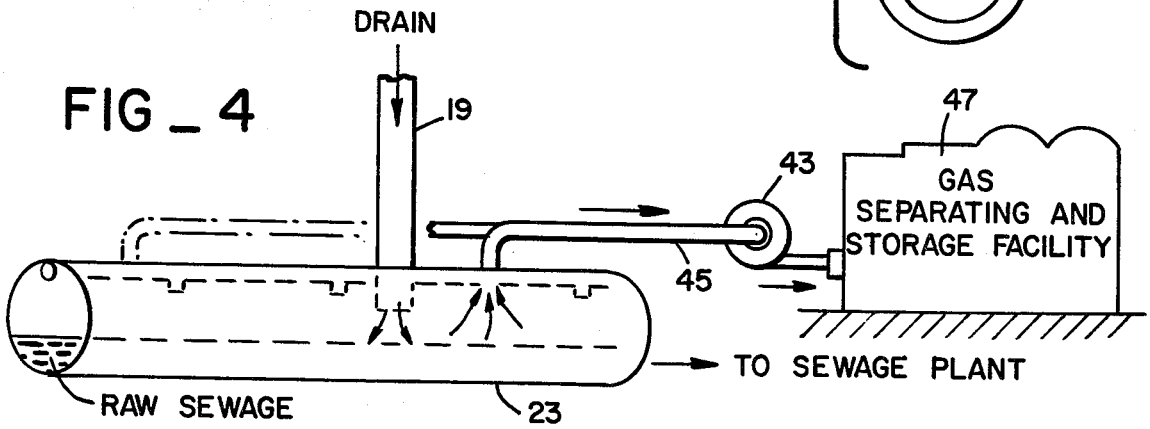

NORMALLY CLOSED SEWAGE VENTING SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates to a sewage system and more particularly to a normally closed sewage venting system that prevents the escape of gases to the atmosphere.

2. Description of the Prior Art

The main function of plumbing vents is to admit air into the plumbing system so that, as a fixture is drained, the water which is to remain within the plumbing trap is not lost down the drain due to syphoning action. Vents that are open to atmosphere admit air into the system as the fixture is drained to prevent this undesirable syphoning action. The function of the trapped water is to prevent the gases which form in the sewage system from coming out of the plumbing fixtures and into homes, factories, and the like. However, the trap does not prevent sewer gases from being lost into the atmosphere or impede trap water evaporation.

In accordance with current design practices plumbing vents, home heating gas stacks, factory gas stacks, gas station tank vents, and the like are all open to atmosphere and all lose gases into the atmosphere.

Various attempts have been made to prevent the escape of vent and stack gases to atmosphere. These have included various type filter units and direct capture of stack gases.

There have been many attempts to utilize existing sewer gases. However, these attempts have been without the ecological and energy recycling advantages of capping off existing open vents with a breather valve in accordance with the present invention.

SUMMARY OF THE INVENTION

Briefly, the present invention comprises a normally closed sewage venting system comprising at least one or more plumbing fixtures having associated traps and drain lines that empty into a main drain that is connected to a sewer main. The main drain is normally directly vented to atmosphere by a plumbing vent. In accordance with the present invention each plumbing vent is capped off with a breather valve. The breather valve is a slit diaphragm valve that readily permits air to enter the system to prevent syphoning from the traps and prevents the escape of gases from the system except under predetermined excessive pressure conditions. Therefore, the gases previously emitted to the atmosphere are now drawn, with the drainage, into the sewer main. The sewer main may be subjected to a slight negative pressure which draws the sewer gases off and into a gas separation and storage facility where the noxious gases can be neutralized and the burnable gases processed and stored.

STATEMENT OF THE OBJECTS OF THE INVENTION

An object of the present invention is to prevent sewage system gases from entering the atmosphere.

Another object of the present invention is to provide a capped off sewage system.

A further object of the present invention is to prevent syphoning of drainage from traps.

Still another object of the present invention is to provide a sewage system wherein the sewer mains are subjected to a slight negative pressure and the sewer gases are withdrawn for further treatment.

Other objects, advantages and novel features of the present invention will become apparent from the following detailed description of the invention when considered in conjunction with the accompanying drawings wherein:

BRIEF DESCRIPTION OF THE DRAWINGS

FIG. 1 is a schematic diagram of the normally closed sewage system of the present invention;

FIG. 1A is a top elevation of the breather valve of the sewage system of FIG. 1;

FIG. 1B is a side elevation and exploded view of the breather valve of FIGS. 1 and 1A;

FIG. 2 is a top elevation of a milti-breather valve of the present invention;

FIG. 4 is a schematic diagram of the overall sewage and venting system employing sewage mains subjected to a slightly negative pressure and a gas treatment facility.

DESCRIPTION OF THE PREFERRED EMBODIMENT

Figure 3:
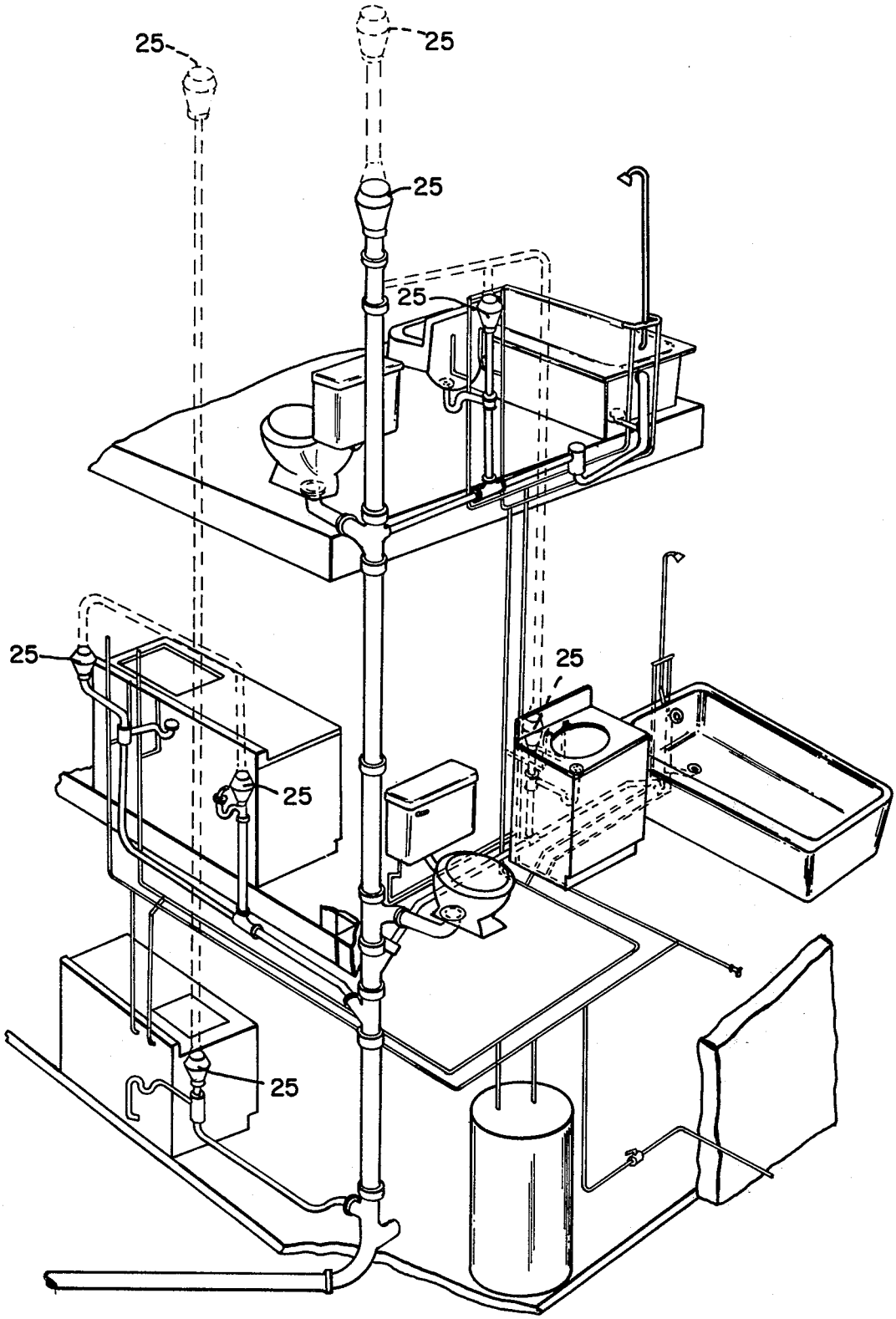
FIG. 3 is a pictorial view of the present invention as may be used in a typical two story dwelling.

In FIGS. 1 through 1B is illustrated the basic concept of the normally closed sewage venting system of the present invention. In FIG. 1 is illustrated a conventional sink 11, having a drain line 13, a trap 15, a drain line 17 which is connected to both the main drain 19 and to the plumbing vent 21. Plumbing vent 21 is normally directly open to the atmosphere. Main drain 19 is normally connected to sewer main 23. It is very important to note that in conventional systems each connection, such as main drain 19 and sewer main 23, are directly open to atmosphere through the plumbing vent 21. Accordingly, gases are continously emitted from the sewer main 23 to the atmosphere. It can therefore be seen that hundreds of thousands of such gas emission sources emit gas, both noxious and burnable, into the atmosphere in any given metropolitan community.

The object of the present invention is to prevent this emission of gases into the atmosphere and still achieve proper plumbing operations. This is achieved by capping off the vent 21 by means of a breather valve 25. The basic feature of breather valve 25 is shown and described below with reference to FIGS. 1A and 1B. However, a detailed description of breather valve 25 may be found in patent application Ser. No. 241,638 filed Apr. 6, 1972 by Jack G. Ohringer. The top elevation of breather valve 25 is illustrated in FIG. 1A and the side elevation and exploded view is shown in FIG. 1B. Breather valve 25 includes upper retainer ring 27, a control plate 29, a slit diaphragm 31 and lower retainer ring 33. The control plate 29 may be made of rigid or elastomeric material and a central control opening 35, which may be round or eliptical, may be employed. The primary advantage or an eliptical central control opening is that the control plate may be rotated to provide a variable sized opening for the slit 37 of the slit diaphragm 31. In this manner the pressure required to permit release of gases to atmosphere may be varied from virtually free flow to any predetermined specified pressure. It should be noted that control plate 29 includes a plurality of openings 39 that surround the central control opening 35 to permit free passage of air into the plumbing vent 21. When larger amounts of air are required to be delivered into the plumbing vent 21 a group of breather valves 25 may be combined into a single large breather valve 41 as generally illustrated in FIG. 2. It is to be understood that this larger breather valve may consist of a plurality of separate valves 25 or it may consist of a plurality of control plates 29 and slit diaphragms 31 which will be retained in place by retainer rings in the larger valve 41.

The operation of the unique sewage system of the present invention is as follows. As sink 11 is drained, fluid passes through drain line 13, trap 15, drain line 17 and empties into main drain 19. Assuming no plumbing vent 21 were employed, then a slug of water passing through main drain 19 would create a partial vacuum which would create a pressure differential at drain line 13 which would force the water in the trap 15 into the main drain 19 and thereby creating a dry trap that would permit sewer gases to freely pass into the building from sewer main 23, main drain 19, drain line 17, trap 15 and drain line 13. To prevent this, conventional systems are directly open to the atmosphere through plumbing vent 21. Therefore, when the slug of drainage passes through main drain 19, a partial vacuum is not created since air passes into the system through plumbing vent 21 thereby maintaining the pressure at the interconnection of drain line 17 and main drain 19 at atmosphere or the same as the pressure at inlet to drain line 13. Therefore, drainage fluid will be retained in trap 15 and thereby prevent gases from passing from the sewer into the building. It should be particularly noted that in the conventional system sewage gases continuously pass from the sewer main 23 through main drain 19 and plumbing vent 21 to atmosphere.

The object of the present invention is to both maintain drainage fluid in the trap and to prevent sewage gases from venting or being released to atmosphere. In addition, the present invention also provides for escape of gases from the sewer main 23 to atmosphere under emergency or relatively high pressure conditions without removing the drainage fluid from the trap.

The above described conditions are achieved by capping off the plumbing vent 21 by means of breather valve 25. The operation of this normally closed sewage venting system is as follows. When sink 11 is drained, fluid passes through drain line 13, trap 15 and drain line 17 and empties into main drain 19 and sewer main 23. The slug of water passing through main drain 19 causes a negative pressure which draws atmospheric air through the breather valve 25 in the downward direction, which is the direction of unimpeded flow, into the system. The atmospheric air is unimpeded in this direction because incoming air passes through the central control opening 35, through the plurality of openings 39, and through slit 37 which is not restricted in opening in the downward direction. Therefore, the pressure at the junction of drain line 17 and main drain 19 is about equal to the inlet pressure of drain line 13 and therefore drainage fluid will be retained in trap 15. In the event that relatively high pressure is encountered in the sewer main 23 it is necessary to vent the gases to atmosphere to avoid removal of drainage fluid from the traps. This is achieved by allowing higher pressure gases to escape through the breather valve through slit 37, central control opening 35 and to either atmosphere or to some other properly vented space. The differential relief pressure of the breather valve 25 is selected, by selection of the size of the central control opening 35, to prevent removal of the drainage fluid from the trap 15. It has been found that a differential pressure of about 1½ inches of water pressure, for example, is satisfactory for most purposes.

In FIG. 3 is illustrated the normally closed sewage venting system of the present invention as may be used in a typical two story dwelling. In this drawing a plurality of breather valves 25 are employed on the vented side of the plumbing system. As illustrated in FIG. 3 the breather valves are located within the dwelling. This is possible because many living spaces such as bath rooms and kitchens are already vented to atmosphere with the capacity to remove gas from human or food waste in excess of what would be normally released, if ever, by the breather valves. It is to be understood that the breather valves 25 may be placed exterior of the dwelling as illustrated in dotted lines in FIG. 3.

As previously explained, and in accordance with the present invention, the air, gases and waste drainage pass into the sewer each time a fixture is flushed. It is to be understood that there are other sources of gases within the sewer system, such as those given off by normal decay, which are being constantly lost through the open vents to the atmosphere. Therefore, it is desirable to remove these gases from the system so that they are not returned to atmosphere. In accordance with the present invention and as generally illustrated in FIG. 4, this is achieved by employing a slight negative pressure on the sewage system for transmittal of gases to a storage and conversion facility. In FIG. 4 this is illustrated by employing a suction pump 43 that is connected to the sewer main 23 by gas removal conduit 45. The gas removal conduit may be perforated and run along the inner upper section of sewer main 23, as shown in dotted lines, or it may be connected at various points along the sewer main or at sewage man holes. The gas from gas removal conduit 45 is transmitted to a gas separation and storage facility 47, located down stream of suction pump 43, where it is processed. The processing may include the burning of gases, the processing and storing of burnable gases for industrial or home use, the neutralizing of noxious gases, the generation of power from burning gases, and the like. These various processes are not herein described since they are well known in the art.

It should be also noted that the gases in the sewage system itself may develop a slight positive pressure. Therefore, a vacuum system may not be necessary because the breather valves may be set to be above this slight positive pressure, while still below trap pressure, and the gases will be transmitted under this pressure to the gas separation and storage facility. It is to be understood that other types of vents, such as from gas tanks, industrial stacks and the like can be conducted to the capped off sewage system for further processing.

What is claimed is:

1. A normally closed sewage venting system for operation in a surrounding open environment having an atmosphere comprising:

(a) a closed environment;

(b) a sewer main;

(c) at least one plumbing fixture located in said closed environment, said closed environment being surrounded by said surrounding open environment and said atmosphere;

(d) a drain line, connecting means for operatively connecting said drain line between said plumbing fixture and said sewer main;

(e) a trap positioned within said drain line;

(f) a two way breather valve having first and second ends, first means for operatively connecting said first end of said breather valve to said drain line downstream of said trap and to said sewer main, said second end of said breather valve in communication with said atmosphere of said open surrounding environment;

(g) said sewer main and drain line for conducting and containing solids, liquids and gases; and (h) said breather valve including breather means for permitting the escape of said gases to atmosphere when the pressure of said gases exceeds the pressure of said atmosphere by a first predetermined amount and permitting said atmosphere to enter said drain line and sewer main when the pressure of said atmosphere exceeds the pressure of said gases by a second predetermined amount, said first predetermined amount being greater than said second predetermined amount and said second predetermined amount being about zero.

2. The system of claim 1 wherein:

(a) said first means comprises an elongated plumbing vent having first and second ends; and (b) said first end of said plumbing vent being operatively connected to said drain line, said second end of said plumbing vent being operably connected to said first end of said two way breather valve, and said second end of said two way breather valve being open to said atmosphere of said open surrounding environment.

3. The system of claim 2 wherein said first predetermined amount is about 1½ inches of water pressure.

4. The system of claim 2 including:

(a) a gas processing facility;

(b) an elongated gas removal conduit that has first and second sections, said first section being positioned within said sewer main and extending along the upper region and along the length of said sewer main;

(c) said first section of said gas removal conduit having a plurality of openings extending along its length and communicating with said sewer main;

(d) said second section of said gas removal conduit extending outside of said sewer main and being connected to a gas processing facility; and (e) a vacuum pump positioned within said second section of said gas removal conduit for withdrawing gases from said sewer main and transferring them to said gas processing facility.

* * * * *